United States Patent [19]

Bassani

[11] 4,066,125

[45] Jan. 3, 1978

[54] SEISMIC DRILL HOLE SURFACE PLUG

[76] Inventor: Peppino Bassani, Box 4091, Edmonton, Alberta, Canada

[21] Appl. No.: 766,812

[22] Filed: Feb. 8, 1977

[30] Foreign Application Priority Data

Dec. 23, 1976 Canada ..... 268639

[51] Int. Cl.[2] ..... F21B 33/12

[52] U.S. Cl. ..... 166/202

[58] Field of Search ..... 166/192, 202, 135

[56] References Cited

U.S. PATENT DOCUMENTS

| | | | |
|---|---|---|---|
| 3,039,534 | 6/1962 | Koop | 166/202 |
| 3,126,827 | 3/1964 | McReynolds, Jr. | 166/202 |
| 3,362,478 | 1/1968 | McReynolds, Jr. | 166/202 |
| 3,419,647 | 12/1968 | Hight et al. | 166/202 |
| 3,593,785 | 7/1971 | Bassani | 166/202 |

*Primary Examiner*—James A. Leppink

*Attorney, Agent, or Firm*—Fetherstonhaugh & Company

[57] ABSTRACT

There is disclosed a means for use in plugging a well including a flexible plug member having a series of alternating long and short fingers radiating outwards from a central area, the fingers having projections for engaging with the wall of the well and together forming a cup-shaped plug to hold concrete poured into the mouth of the well to provide a plug.

5 Claims, 5 Drawing Figures

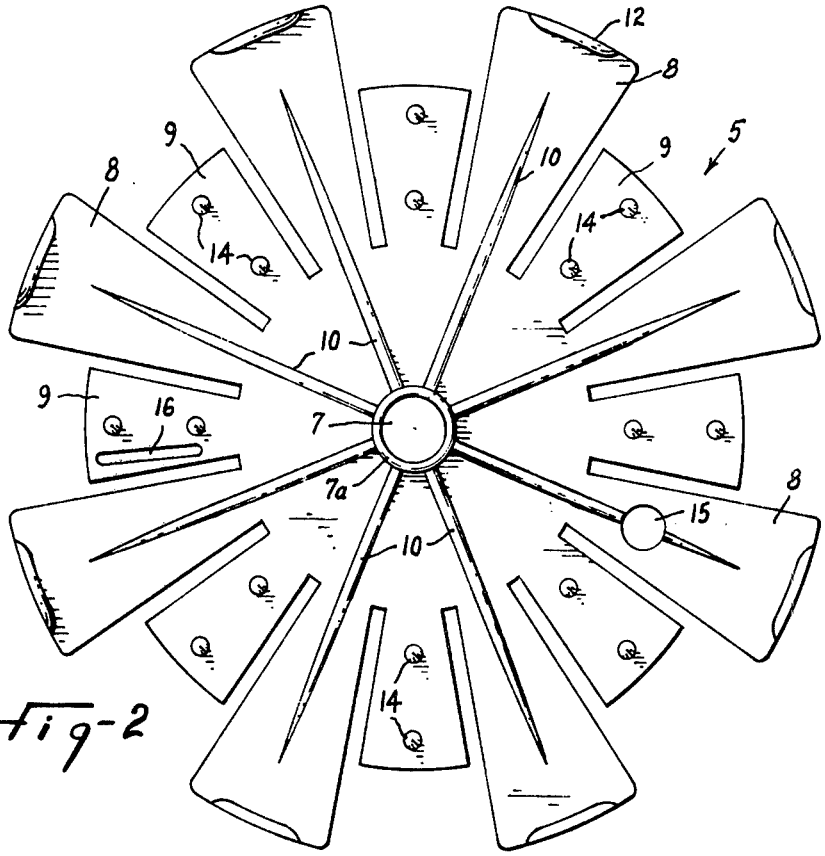
Fig-2
Fig-5
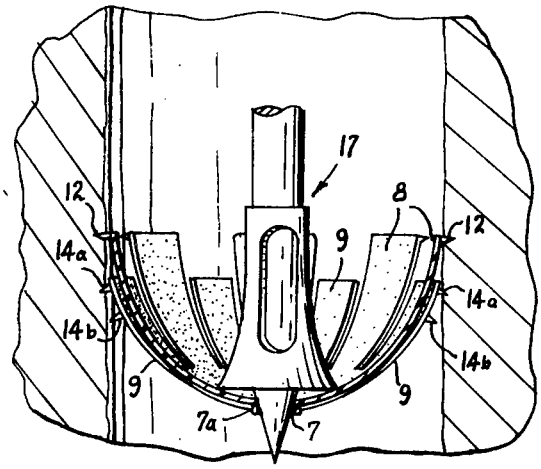

SEISMIC DRILL HOLE SURFACE PLUG

This invention relates to a device for plugging seismic holes or wells and is an improvement on my previous U.S. Pat. No. 3,593,785, issued July 20, 1971.

In U.S. Pat. No. 3,593,785, in addition to the actual member which plugged the seismic hole or well, there was provided a ring member which was initially attached to the plug member, and a series of cords connected the plug member with the ring member. When the seismic hole or well was to be plugged, the ring member was detached from the plug member and was anchored close to the ground surface while the plug member was inserted into the seismic hole or well to the extent permitted by the length of the cords connecting the two members.

In the present invention, only a plug member is required and it is inserted into the well hole by means of a stinger rod which pushes the plug member down into the well hole for a distance of approximately 18 inches.

The plug member in the present invention is molded of plastic material and consists of a series of alternating long and short fingers radiating outwardly from a central area. The fingers flex upwardly when the plug is inserted into the well hole and readily accommodate to variations in the diameter of the well hole. A centrally located aperture is provided into which the lower end of the stinger rod is inserted. The outer ends of the long fingers are provided with downturned sharp edge portions for engaging with the surface of the well hole, while the short fingers are provided with downwardly pointed conical projections which also engage with the surface of the well hole. The sharp edges of the long fingers and the conical projections of the short fingers together provide axially spaced apart annular engagements of the plug with the surface of the well hole.

It is, therefore, an object of the invention to provide a seismic drill hole or well plugging device of unitary construction without attachments such as anchoring rings or cords.

A further object of the invention is to provide a seismic drill hole or well plug of flexible plastic which has a series of fingers with protrusions on their under surfaces for engaging with the surface of the seismic drill hole or well.

A further object of the invention is to provide a series of flexible fingers in a seismic drill hole or well plug in which protrusions on their under side provide axially spaced apart gripping points with the surface of the seismic drill hole or well.

A further object of the invention is to provide a plug for seismic drill holes or wells made of plastic and which is flat in form and can be packed into small bulk until they are to be used.

These and other objects of the invention will be apparent from the following detailed specification and the accompanying drawings in which:

FIG. 2 is a bottom plan view of the plug shown in FIG. 1.

FIG. 5 shows the invention deployed in a well hole by means of a stinger rod, prior to plugging the well hole with cement or grout.

Figure 1:
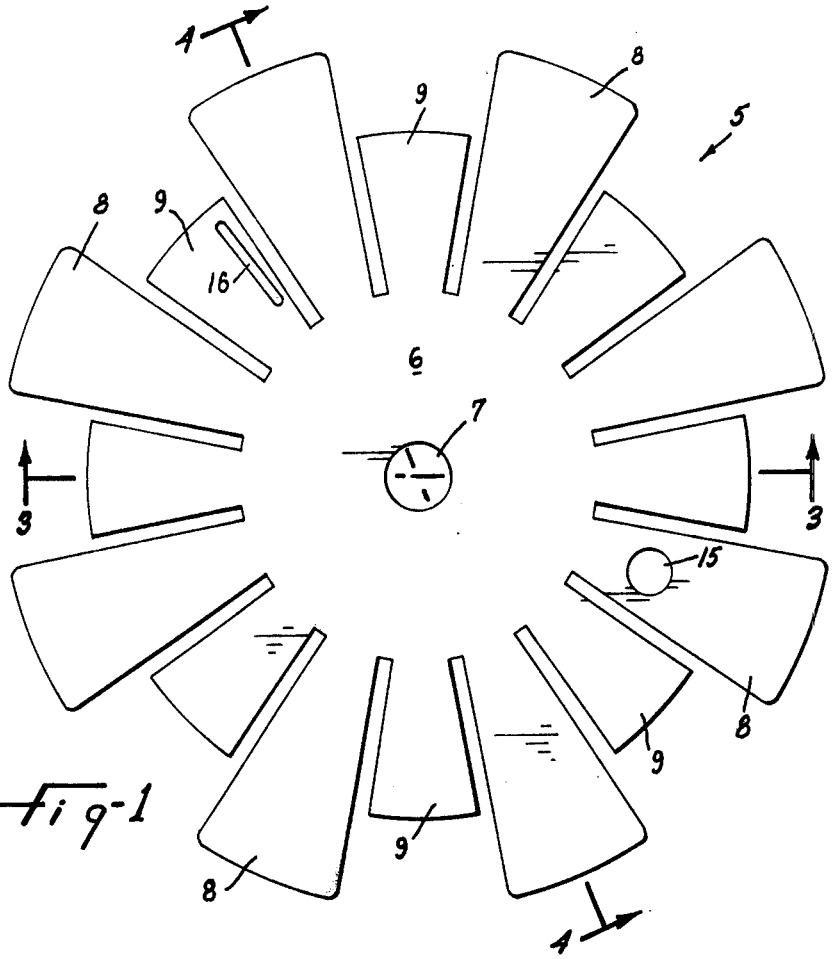
FIG. 1 is a top plan view of the seismic drill hole plug according to the present invention.
Figure 3:
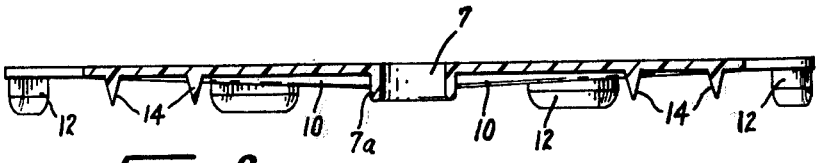
FIG. 3 is a horizontal section taken on the line 3—3 of FIG. 2.
Figure 4:
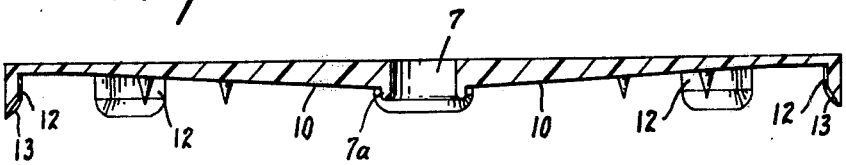
FIG. 4 is a horizontal section taken on the line 4—4 of FIG. 2.

Referring to the drawings, the seismic drill hole or well plug 5 is molded of plastic material, generally circular in shape, and has a central solid area 6 about a central aperture 7. The aperture 7, on the under side of the plug 5, is defined by a wall **7*a*, as shown in FIGS. 2, 3 and 4**.

Radiating outwards from the central solid area 6 is a series of fingers 8 alternating with a series of fingers 9. The side edges of the fingers 8 and 9 are parallel and are slightly spaced apart from each other. The fingers 8 are considerably longer than the fingers 9.

The fingers 8, on their under side, are strengthened by ribs 10 radiating outwards from the annular wall 11 which surrounds the central aperture 7. Also, on the under side of the fingers 8 there is provided, on their peripheral edge, a projection 12 whose downward edge is tapered inwardly at 13.

The fingers 9, also on their under side, are provided with at least two conical projections 14 disposed in spaced apart radial alignment.

The circular aperture 15 in one of the fingers 8 and the slot 16 in one of the fingers 9 is for the purpose of affixing the permit tags, issued by the Provincial Government to the seismic drill crew in connection with a particular seismic drill hole project in which the crews are involved.

In the operation of plugging a seismic drill hole or well using the above described plug, the plug 5 is forced down into the hole by the stinger rod 17, as shown in FIG. 5. As the plug 5 enters the hole, the long fingers 8 are flexed upwards and their end projections 12 take an attitude more normal to and engage with the surface of the seismic hole. This is followed by the shorter and more rigid fingers 9 flexing upwards to the point where first the outer conical projection **14*a* engages with the surface of the hole, followed by the inner conical projection 14*b*** engaging with the surface of the hole.

Due to the radial spacing of the projections 12 on the longer fingers 8 and the conical projections **14*a* and 14*b* on the shorter fingers 9, there is provided not only a multiplicity of gripping points circumferentially, but a multiplicity of gripping points axially on the surface of the seismic drill hole or well, thus adding greatly to the stability of the plug 5** in the hole while the concrete or grout is being poured to close the hole.

The embodiments of the invention in which an exclusive property or privilege is claimed are defined as follows:

1. A plug for use in plugging seismic drill holes or wells, the said plug being formed of flexible material and being circular in shape, having a diameter larger than the diameter of the well to be plugged, characterized in that the plug has a central aperture surrounded by a solid portion, and a series of fingers project radially outwards from the said solid portion, each of said fingers on one surface thereof having well surface gripping protrusions projecting therefrom.

2. A plug as set forth in claim 1 in which the said fingers include long fingers and short fingers, the said long and short fingers alternating with each other circumferentially.

3. A plug as set forth in claim 1 in which the well surface gripping protrusions on the said long fingers are projected along the outer peripheral edge of the fingers, each projection having an edge portion tapered inwardly towards the adjacent surface of the fingers.

4. A plug as set forth in claim 1 in which the well surface gripping protrusions on the said short fingers are conical shaped and located in spaced apart radial alignment.

5. A plug as set forth in claim 1 in which the said central aperture is surrounded by a raised wall on the one side of the plug from which the said well surface gripping protrusions project, and a rib member extends radially outwards from the said raised wall centrally along a substantial length of the said long fingers.

* * * * *